United States Patent [19]

Dorow et al.

[11] Patent Number: 5,003,878

[45] Date of Patent: Apr. 2, 1991

[54] APPARATUS FOR CLAMPING PRINTING PLATES

[75] Inventors: Joachim Dorow, Hassloch; Gerhard Bleckmann, Lampertheim, both of Fed. Rep. of Germany

[73] Assignee: BASF Aktiengesellschaft, Ludwigshafen, Fed. Rep. of Germany

[21] Appl. No.: 142,997

[22] Filed: Jan. 12, 1988

[30] Foreign Application Priority Data

Jan. 24, 1987 [DE] Fed. Rep. of Germany ..... 3702032

[51] Int. Cl.[5] ..... B41F 13/08; B41F 27/06

[52] U.S. Cl. ..... 101/415.1; 101/378

[58] Field of Search ..... 101/415.1, 382 R, 383, 101/385, 386, 378; 51/364

[56] References Cited

U.S. PATENT DOCUMENTS

| | | | |
|---|---|---|---|
| 3,012,841 | 12/1961 | Autere et al. | 101/415.1 |
| 3,043,219 | 7/1962 | Dietrich | 101/415.1 |
| 4,092,925 | 6/1978 | Fromson | 101/415.1 |
| 4,515,375 | 5/1985 | Bleckman et al. | 101/415.1 |

*Primary Examiner*—Paul T. Sewell
*Assistant Examiner*—Kimberly L. Asher
*Attorney, Agent, or Firm*—Keil & Weinkauf

[57] ABSTRACT

In an apparatus for clamping printing plates for printing presses comprising two clamping strips which are displaceably arranged in a cylinder recess and held by two leaf springs and hook under an end region of the printing plate to be clamped and whose outer contours, in the clamped state, have a curvature corresponding to the cylinder curvature and each of which is bounded by a thrust surface which engages a bent-over edge claw of the printing plate to be clamped, a resilient hose being inserted between the thrust surfaces of the clamping strips and the clamping strips themselves, the clamping strips are adjustable on the one hand in the clamping direction of the printing plates by means of two cams arranged in depressions and on the other hand in a direction opposite to the clamping direction of the printing plates by means of a cam arranged between the leaf springs and in the vertical plane of symmetry of the cylinder.

1 Claim, 2 Drawing Sheets

APPARATUS FOR CLAMPING PRINTING PLATES

The present invention relates to an apparatus for clamping printing plates (referred to hereafter as plates) for printing presses, comprising two clamping strips which are displaceably arranged in a cylinder recess and held by two leaf springs and hook under an end region of the plate to be clamped and whose outer contours, in the clamped state, have a curvature corresponding to the cylinder curvature and each of which is bounded by a thrust surface which engages a bent-over edge claw of the plate to be clamped, a resilient hose being inserted between the thrust surfaces of the clamping strips and the clamping strips themselves.

An apparatus of this type is disclosed in Pat. Application No. P 36 16 425.9. This essentially consists of two clamping strips which are arranged in a cylinder recess and in which the radially outer end surfaces of the vertical limbs facing one another have a curvature corresponding to the cylinder curvature. The radially outer edges of the two clamping strips, which edges face one another, are in the form of nose-shaped edges having clamping surfaces which form an acute angle with the peripheral contour and define a clamping channel which converges in an outward direction. The limbs of the clamping strips, which limbs face away from one another, engage an associated guide groove in the cylinder, this groove being bordered on the one hand by the bottom of the cylinder recess and on the other hand by inserts in the region of the side walls of the cylinder recess, under which inserts the horizontal limbs of the clamping strips engage. When screwed to the cylinder the outer contours of these inserts also correspond to the cylinder curvature.

A plastic hose, a deformable tube or the like, filled with gap-closing compound, is arranged between the clamped surfaces of the clamping strips, the clamping strips and a squeeze strip which is radially displaceable toward the periphery of the cylinder, the said hose or tube being provided along its entire length, which corresponds to the cylinder length, with orifices facing the plate to be clamped. Two or more commercial hydraulic cylinders are incorporated in each of the inserts, one for pressing the clamping strips against one another and one for forcing the clamping strips apart.

Production of the apparatus described above is complicated and therefore expensive.

It is an object of the present invention to design an apparatus which is simpler to produce.

We have found that this object is achieved, according to the invention, if the clamping strips are adjustable on the one hand in the clamping direction of the printing plates by means of two cams arranged in depressions and on the other hand in a direction opposite to the clamping direction of the printing plates by means of a cam arranged concentrically between the leaf springs and in the cylinder axis.

Figure 1:
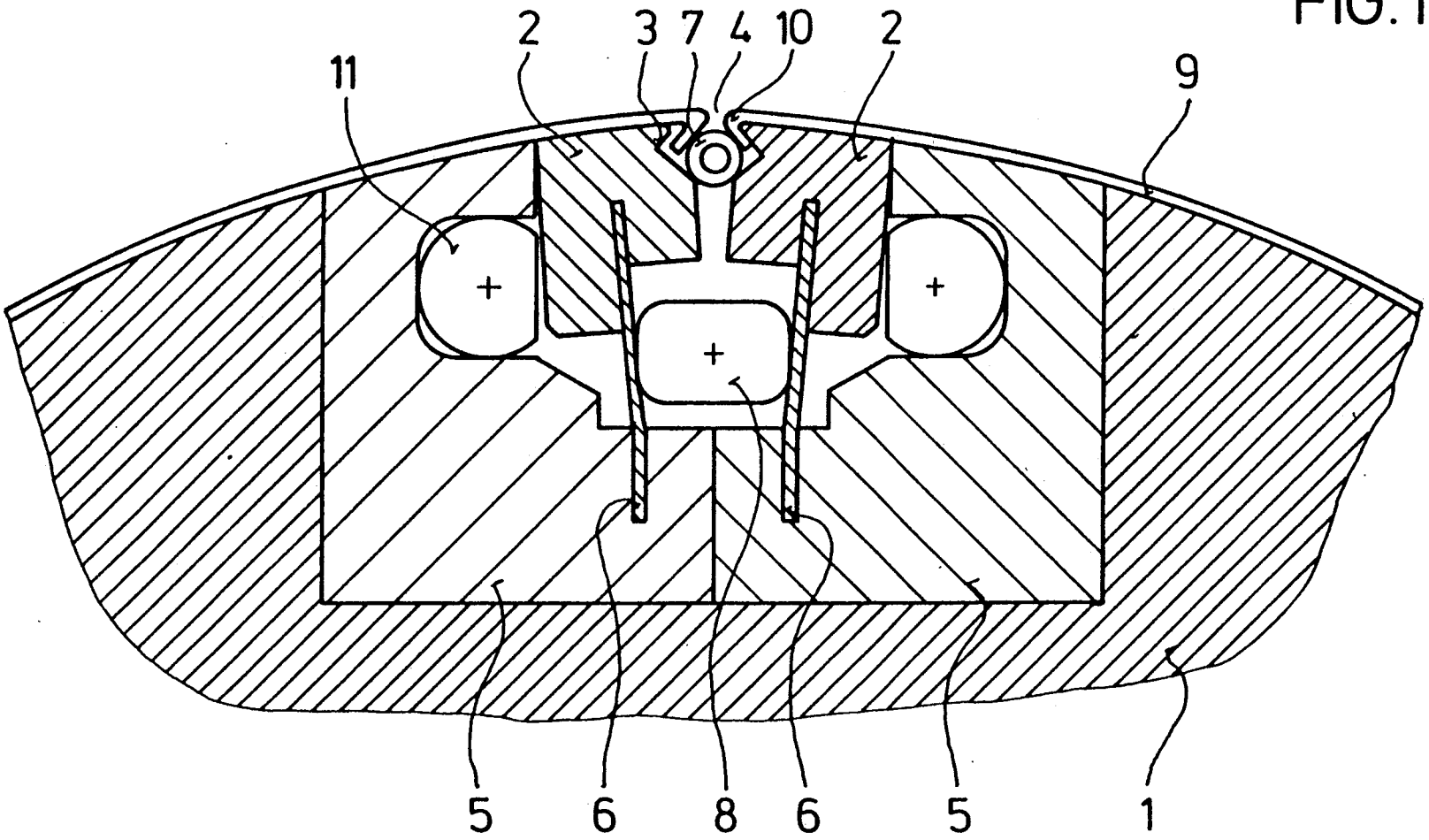
Figure 2:
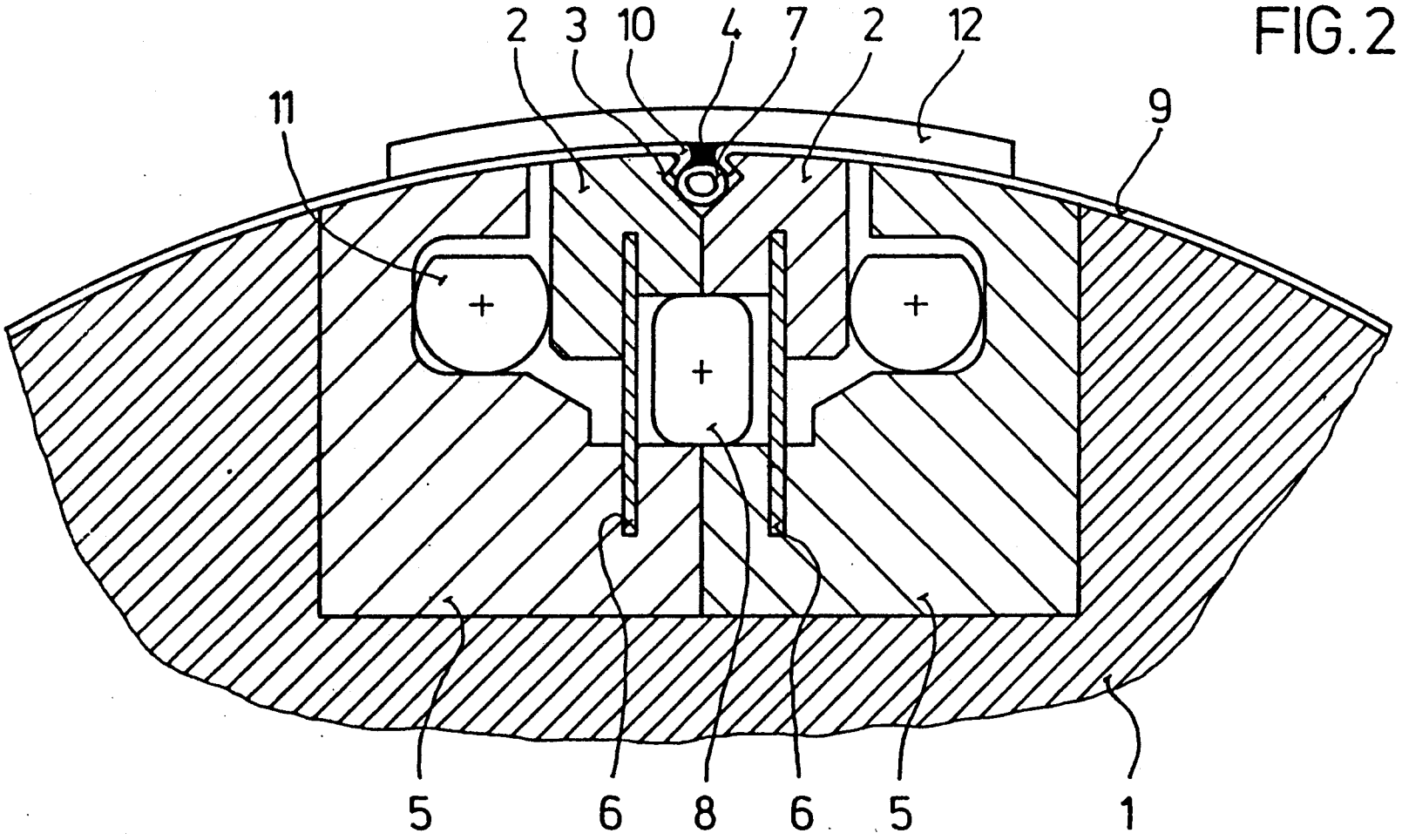

An embodiment of the invention is described hereinafter in detail by reference to a drawings, in which FIG. 1 shows a radial section through the novel apparatus having two clamping strips, these strips not being in the clamped position and FIG. 2 shows the same section, except that the two clamping strips are in the clamped position.

The apparatus essentially consists of the two clamping strips 2 which are arranged in a cylinder recess 1 and are symmetrical with respect to a radial plane and in which the radially outer end surface possesses, in the clamped state, a curvature corresponding to the cylinder curvature. The radially outer edges of the two clamping strips, which edges face one another, are in the form of nose-shaped edges having clamping surfaces 3 which form an acute angle with the peripheral contour and define a clamping channel 4 which converges in an outward direction. In the unclamped state of the clamping strips, said strips are each held by a leaf spring 6, clamped in inserts 5. These inserts are likewise introduced into the cylinder recess and are screwed to the cylinder, and the outer contours likewise correspond to the cylinder contour. A cam 8 is arranged between the leaf springs and the vertical plane of symmetry of the cylinder. A resilient hose 7, filled with gap-closing compound, is arranged between the clamping surfaces 3 of the clamping strips 2 and the clamping strips themselves, said hose being provided along its entire length, which corresponds to the cylinder length, with one or more orifices facing the plate 9 to be clamped. Two cams 11 are each inserted into depressions in the inserts, along the entire length of the latter. When the clamping strips are in the clamped position, these cams are supported on one of their sides, via the inserts, against the fixed cylinder wall.

The plate 9 to be clamped is provided in the region of its ends with edge claws 10 which are bent at an acute angle and grip the clamping surfaces. When the edge claws 10 are pressed against the associated clamping surface 3 by rotating the two cams 11 through 90°, the resilient hose 7 which is arranged in the clamping channel 4 and is filled with gap-closing compound is deformed by the clamping strips 2 in such a way that the gap-closing compound is forced through the orifices in the hose and toward the outer contour of the cylinder. Shaped piece 12, which constitutes the upper limit for gap closure, is located above the outer contour, in the region of the gap. In this case, the cam 8 is in the position shown in FIG. 2. To open the apparatus to allow the plate to be removed from the cylinder, first cam 11 is rotated back through 90° and then cam 8 is rotated into the position shown in FIG. 1. In another possible method of closing the gap between the two bent-over edge claws of the plate, after the plate has been clamped the gap-closing compound can be forced into the cavity formed by the bent-over edge claws of the plate, the hose and the shaped piece.

We claim:

1. Apparatus for clamping printing plates for printing presses comprising two clamping strips which are displaceably arranged in a cylinder recess and held by two leaf springs and hook under an end region of the printing plate to be clamped and whose outer contours, in the clamped state, have a curvature corresponding to the cylinder curvature and each of which is bonded by an inner surface terminating at the top in a thrust surface which engages a bent-over edge claw of the printing plate to be clamped, wherein two cams are rotatably mounted in said recess outwardly of said clamping strips, which cams, upon rotation, displace said clamping strips, respectively, in the clamping direction of the printing plate;

wherein a third cam is rotatably mounted between the leaf springs and in the vertical plane of symmetry of the apparatus, said third cam, upon rotation, engaging said springs in the unclamping direction of the printing plate to displace said clamping strips in the last-mentioned direction; and wherein a resilient hose filled with a sealing compound and having at least one orifice along its length facing the printing plate to be clamped is inserted between said clamping strips in the region below said thrust surfaces, said inner surfaces of the clamping strips being formed so that as the clamping strips are displaced toward the clamped state under the control of the first-mentioned two cams, said resilient hose is deformed by said clamping strips to force the sealing compound through said orifice out of said hose and toward said end region of the printing plate.

* * * * *